US010676238B2

(12) United States Patent
Poran et al.

(10) Patent No.: US 10,676,238 B2
(45) Date of Patent: Jun. 9, 2020

(54) ANTI-SAGGING DEVICES AND ASSEMBLIES FOR RACKING PALLETS

(71) Applicant: PLASGAD PLASTIC PRODUCTS ACS LTD., Upper Galilee (IL)

(72) Inventors: Iftah Poran, Ramat Hagolan (IL); Michal Moses, Ramat Hagolan (IL)

(73) Assignee: PLASGAD PLASTIC PRODUCTS ACS LTD, Kibbutz Gadot (IL)

( * ) Notice: Subject to any disclaimer, the term of this patent is extended or adjusted under 35 U.S.C. 154(b) by 0 days.

(21) Appl. No.: 16/264,730

(22) Filed: Feb. 1, 2019

(65) Prior Publication Data

US 2019/0185206 A1 Jun. 20, 2019

(30) Foreign Application Priority Data

Nov. 11, 2018 (GB) ..... 1818339.2

(51) Int. Cl.
*B65D 19/00* (2006.01)
*B65D 19/38* (2006.01)

(52) U.S. Cl.
CPC ..... *B65D 19/0026* (2013.01); *B65D 19/004* (2013.01); *B65D 19/0018* (2013.01); *B65D 19/0048* (2013.01); *B65D 19/38* (2013.01); *B65D 2519/00034* (2013.01); *B65D 2519/00069* (2013.01); *B65D 2519/0094* (2013.01); *B65D 2519/0098* (2013.01); *B65D 2519/0099* (2013.01); *B65D 2519/00139* (2013.01); *B65D 2519/00268* (2013.01); *B65D 2519/00273* (2013.01); *B65D 2519/00288* (2013.01); *B65D 2519/00308* (2013.01); *B65D 2519/00318* (2013.01); *B65D 2519/00323* (2013.01); *B65D 2519/00333* (2013.01); *B65D 2519/00338* (2013.01); *B65D 2519/00402* (2013.01); *B65D 2519/00412* (2013.01); *B65D 2519/00432* (2013.01); *B65D 2519/00567* (2013.01); *B65D 2519/00796* (2013.01)

(58) Field of Classification Search
CPC ..... B65D 2519/00368; B65D 2519/00552; B65D 2519/00547
USPC ..... 108/51.11, 56.3, 56.1, 57.25, 57.26
See application file for complete search history.

(56) References Cited

U.S. PATENT DOCUMENTS 3,247,810 A * 4/1966 Sepe ..... B65D 19/0075 108/53.3
3,667,403 A * 6/1972 Angelbeck, Jr. ... B65D 19/0012 108/57.26
4,344,368 A * 8/1982 Remington ..... B65D 19/0022 108/55.1
4,735,154 A * 4/1988 Hemery ..... B65D 19/0012 108/56.1
5,117,762 A * 6/1992 Shuert ..... B65D 19/0022 108/57.25

(Continued)

*Primary Examiner* — Jose V Chen
(74) *Attorney, Agent, or Firm* — Mark David Torche; Patwrite Law

(57) ABSTRACT

An anti-sagging device, configured to conform with a lightweight pellet, is described. Details of assemblies of a lightweight pellet and the novel anti-sagging devices are further described. An assembly of a lightweight pellet and the novel anti-sagging devices is characterized by superior structural firmness, so that upon placing the assembly onto two side-beams of a racking or shelving structure, the assembly effectively does not sag remains essentially planar or linear.

18 Claims, 8 Drawing Sheets

(56) References Cited

U.S. PATENT DOCUMENTS 5,483,899 A * 1/1996 Christie ..... B65D 19/0073 108/56.3
6,032,801 A * 3/2000 Jupille ..... B65D 1/38 108/55.3
6,053,466 A * 4/2000 Jordan ..... B65D 19/0026 108/57.24
6,446,563 B1 * 9/2002 Ohanesian ..... B65D 19/0012 108/53.3
6,776,298 B2 * 8/2004 Courtwright ..... B65G 1/026 211/183
7,490,561 B1 * 2/2009 Chou ..... B65D 19/0095 108/56.1
7,607,542 B1 * 10/2009 Hsieh ..... B65D 19/18 108/56.3
7,661,373 B2 * 2/2010 Apps ..... B65D 19/0012 108/56.3
7,780,140 B1 * 8/2010 Ward ..... E02D 27/44 248/678
8,006,629 B2 * 8/2011 Naidu ..... B65D 19/0038 108/56.3
8,291,839 B2 * 10/2012 Apps ..... B65D 19/004 108/53.3
8,424,468 B2 * 4/2013 Aden ..... B65D 19/0026 108/56.3
8,448,582 B2 * 5/2013 Jian ..... B65D 19/0097 108/56.3
8,887,646 B2 * 11/2014 Skudutis ..... B65D 19/0012 108/56.3
8,950,342 B2 * 2/2015 Plattner ..... B65D 19/0016 108/56.3
9,221,580 B2 * 12/2015 Zelek ..... B65D 19/0018
9,242,760 B2 * 1/2016 Nevo ..... B65D 19/0018
2006/0169185 A1 * 8/2006 Williams, Jr. ..... B65D 19/0095 108/56.3
2009/0020045 A1 * 1/2009 Brunsmann ..... B65D 19/385 108/53.5
2009/0064906 A1 * 3/2009 Cance ..... B65D 19/0038 108/56.3
2011/0253016 A1 * 10/2011 Leakey ..... B65D 19/0012 108/56.3
2013/0220184 A1 * 8/2013 Apps ..... B65D 19/0004 108/56.1
2015/0274358 A1 * 10/2015 Hidalgo ..... B65D 19/0095 108/56.3

* cited by examiner

ANTI-SAGGING DEVICES AND ASSEMBLIES FOR RACKING PALLETS

CROSS REFERENCE TO RELATED APPLICATIONS

This application claims priority under the Paris Convention on United Kingdom Patent Application No. 1818339.2 filed on Nov. 11, 2018, the entire content of which is herein incorporated by reference

TECHNICAL FIELD

In general, the present invention pertains to the art of storage and transportation. In particular, the invention relates to anti-sagging devices and assemblies thereof, facilitating racking of pallets.

BACKGROUND OF THE INVENTION

It is believed that the current state of the art is represented by the following patent literature: U.S. Pat. Nos. 3,824,933, 6,053,466, 8,006,629, 9,592,929, USD0798024, US2013180437, WO2011040758 and WO2013060900.

USD0798024 discloses a nestable pallet.

WO2011040758 discloses a lightweight pallet to be used in loading and unloading goods using a forklift truck. The lightweight pallet of WO2011040758 comprises: a pallet plate unit formed into the shape of a plate having an upper surface on which goods are loaded; a pallet rib unit bent upwardly or downwardly from the pallet plate unit to support the pallet plate unit; a thermally bonded unit formed by thermally bonding both sides of a rib at the intermediate portion of each rib in a lengthwise direction such that the ribs of the pallet rib unit have cohesive force in a lengthwise direction or a vertical direction; and a plurality of pallet support units bent downwardly from the pallet plate unit to support the pallet plate unit such that the pallet plate unit has a predetermined height.

U.S. Pat. No. 8,006,629 discloses a pallet includes an upper and lower deck. The upper deck in U.S. Pat. No. 8,006,629 includes snap-pin openings. First joining members in U.S. Pat. No. 8,006,629 project downwardly from the upper deck, with each first joining member including an outer sleeve surrounding a respective snap-pin opening. Second joining members in U.S. Pat. No. 8,006,629 project upwardly from the lower deck, with each second joining member including an inner sleeve and a snap-pin receiving cavity positioned therein. The inner sleeves receive the outer sleeves to define support blocks joining the upper and lower decks. Snap-pins are inserted into the snap-in openings in the upper deck. Each snap-pin includes a head for engaging a snap-pin opening, and spaced apart tips that extend through the snap-pin receiving cavity for engaging a backside of the inner sleeve associated therewith.

SUMMARY OF THE INVENTION

The invention was made in view of the deficiencies of the prior art and provides systems, methods and assemblies for overcoming these deficiencies. According to some embodiments and aspects of the present invention, there are provided anti-sagging devices and assemblies thereof, facilitating racking and/or shelving of pallets.

In accordance with some embodiments of the present invention there are provided anti-sagging devices and assemblies thereof, facilitating racking and/or shelving of light and/or lightweight pallets In accordance with some embodiments of the present invention there are provided anti-sagging devices and assemblies thereof, facilitating racking and/or shelving of nestable pallets.

In accordance with some embodiments of the present invention there are provided anti-sagging devices and assemblies thereof, facilitating racking and/or shelving of light and/or lightweight nestable pallets.

In accordance with some embodiments of the present invention there are provided anti-sagging devices and assemblies thereof, facilitating racking and/or shelving of pallets, without substantially adding to the vertical dimension of the assembly.

In accordance with some embodiments of the present invention there are provided anti-sagging devices and assemblies thereof, facilitating racking and/or shelving of pallets, liftable by a forklift.

Definitions

The term pallet, as referred to herein, indicates pallets which typically have top and boards with runners therebetween, skids which typically have only top boards supported on runners and other such supporting devices.

BRIEF DESCRIPTION OF THE DRAWINGS

The present invention will be understood and appreciated more comprehensively from the following detailed description taken in conjunction with the appended drawings in which.

DETAILED DESCRIPTION OF THE INVENTION

Illustrative embodiments of the invention are described below. In the interest of clarity, not all features of actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another. Moreover, it will be appreciated that the effort of such a development might be complex and time-consuming, but would nevertheless be a routine undertaking for those of ordinary skill in the art having the benefit of this disclosure.

Figure 1:
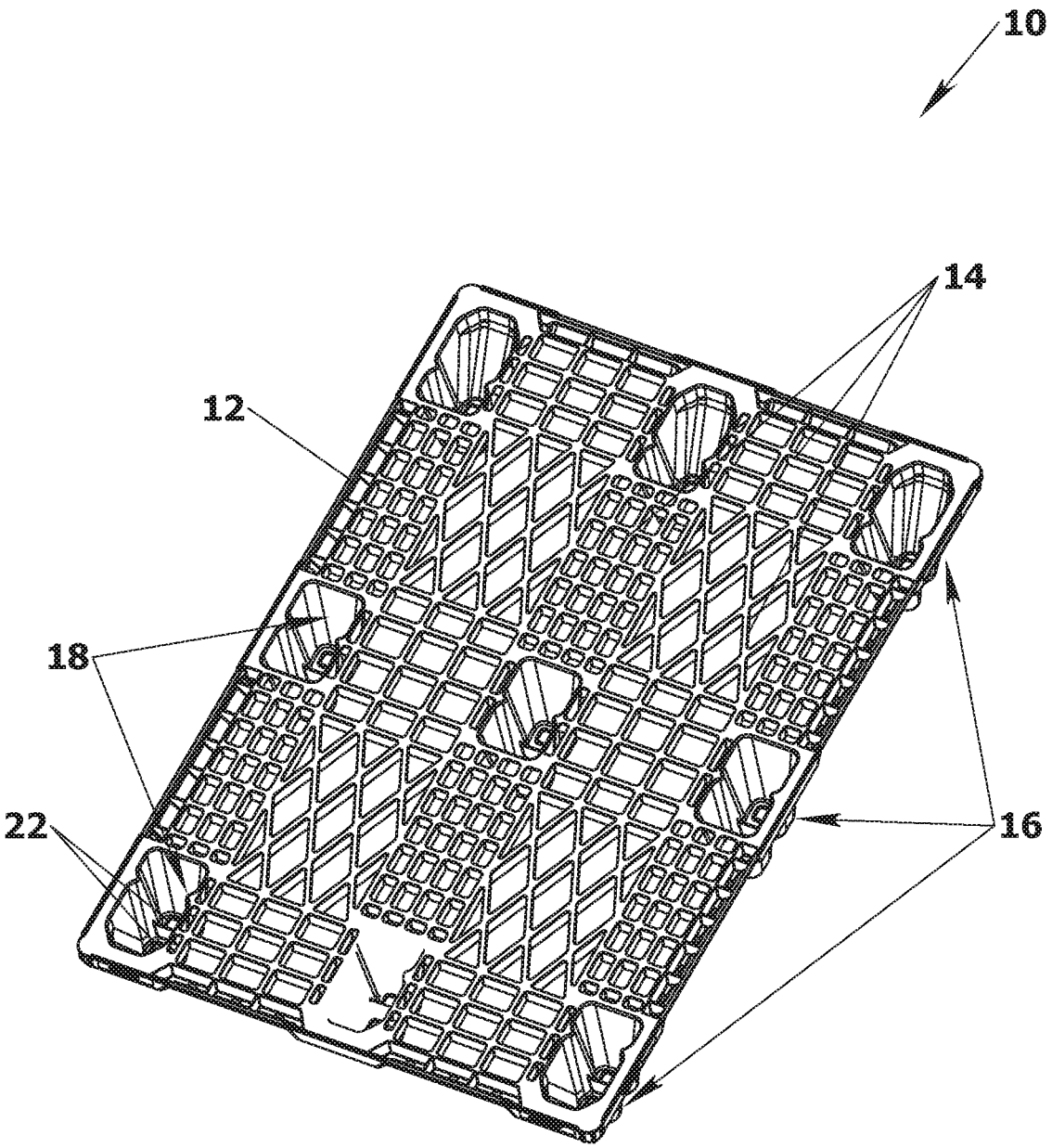
Fig. 1 PRIOR ART
FIG. 1 is a perspective view of a prior art lightweight pellet pallet.
Figure 2:
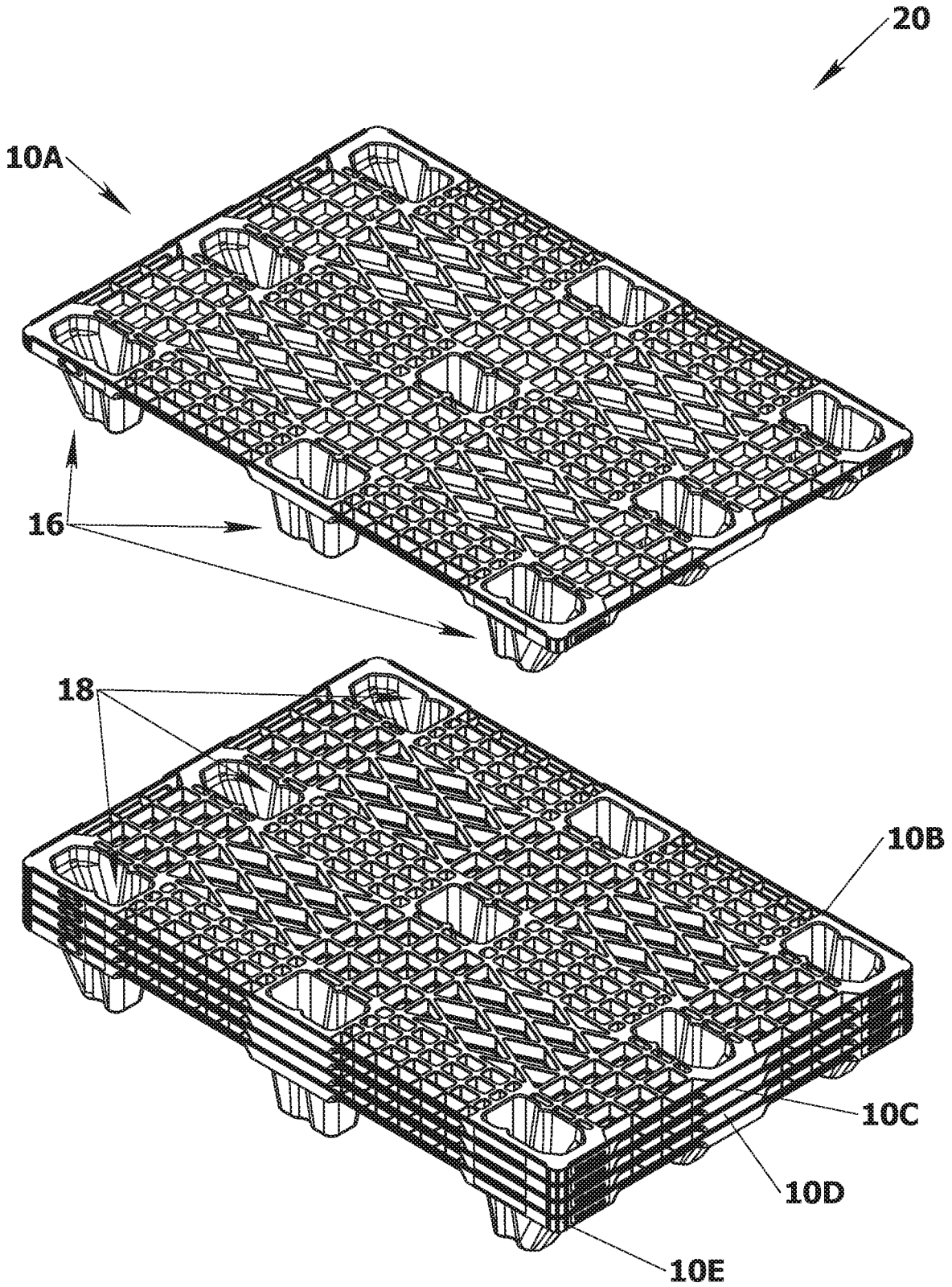
Fig. 2 PRIOR ART
FIG. 2 is an isometric view of an assembly of two nested prior art lightweight pellets pallets.
Figure 3A:
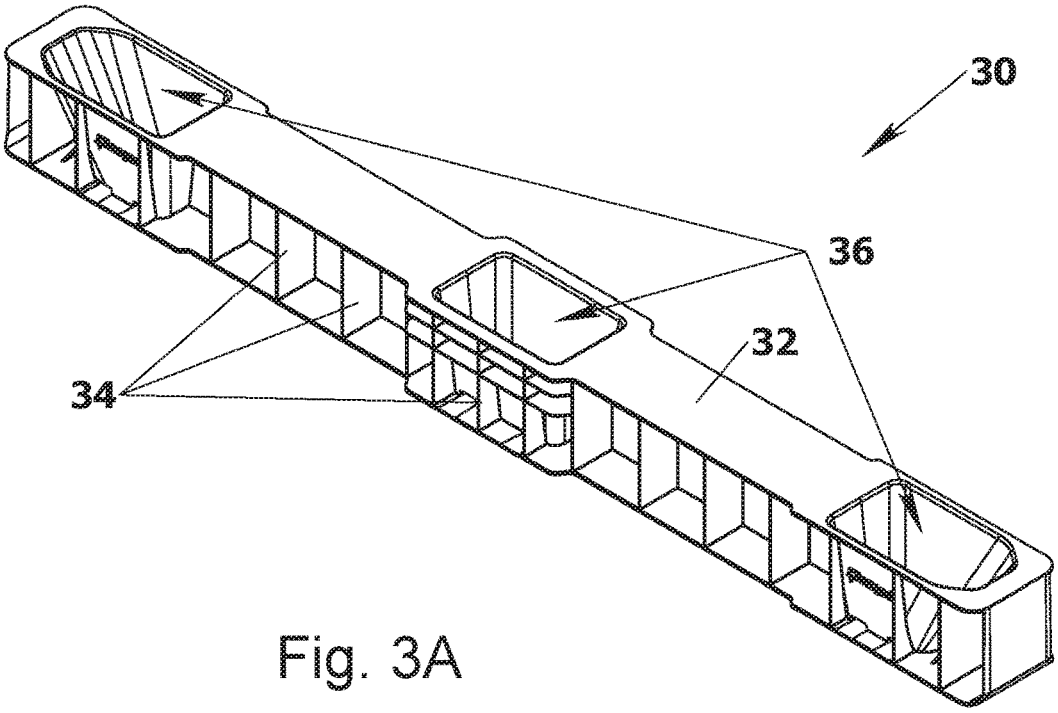
FIG. 3A is an isometric view of an embodiment of an anti-sagging device of the invention, for racking and/or shelving of pallets.
Figure 3B:
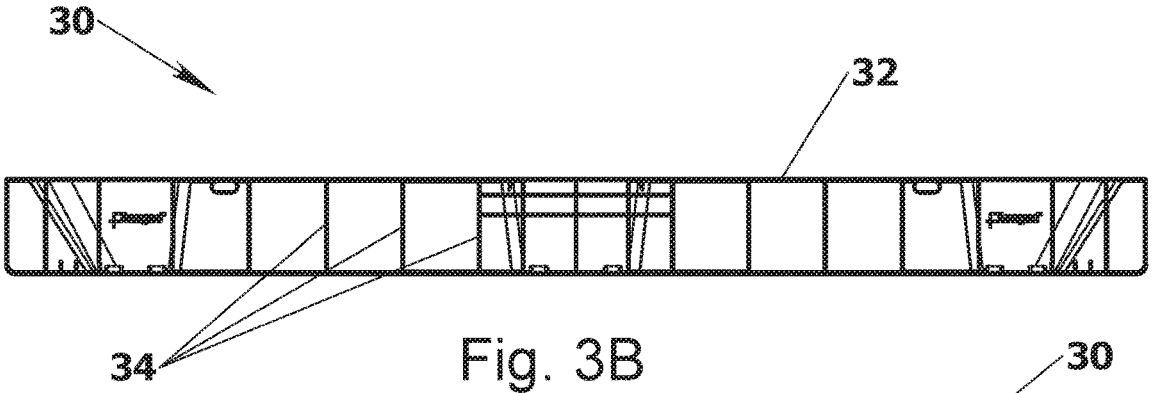
FIG. 3B is a front view of an embodiment of an anti-sagging device of the invention, for racking and/or shelving of pallets.
Figure 3C:
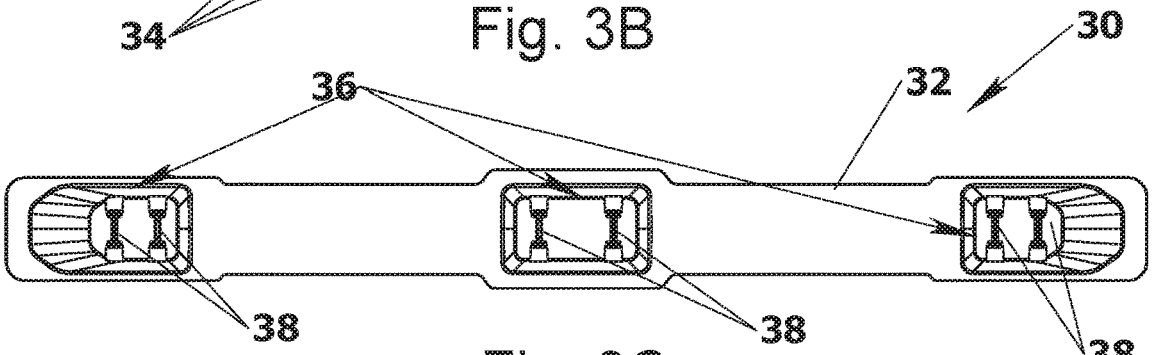
FIG. 3C is a top view of an embodiment of an anti-sagging device of the invention, for racking and/or shelving of pallets.
Figure 3D:
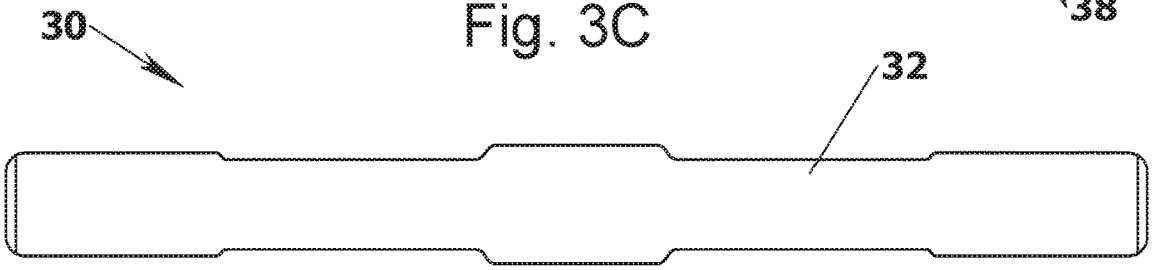
FIG. 3D is a bottom view of an embodiment of an anti-sagging device of the invention, for racking and/or shelving of pallets.
Figure 4A:
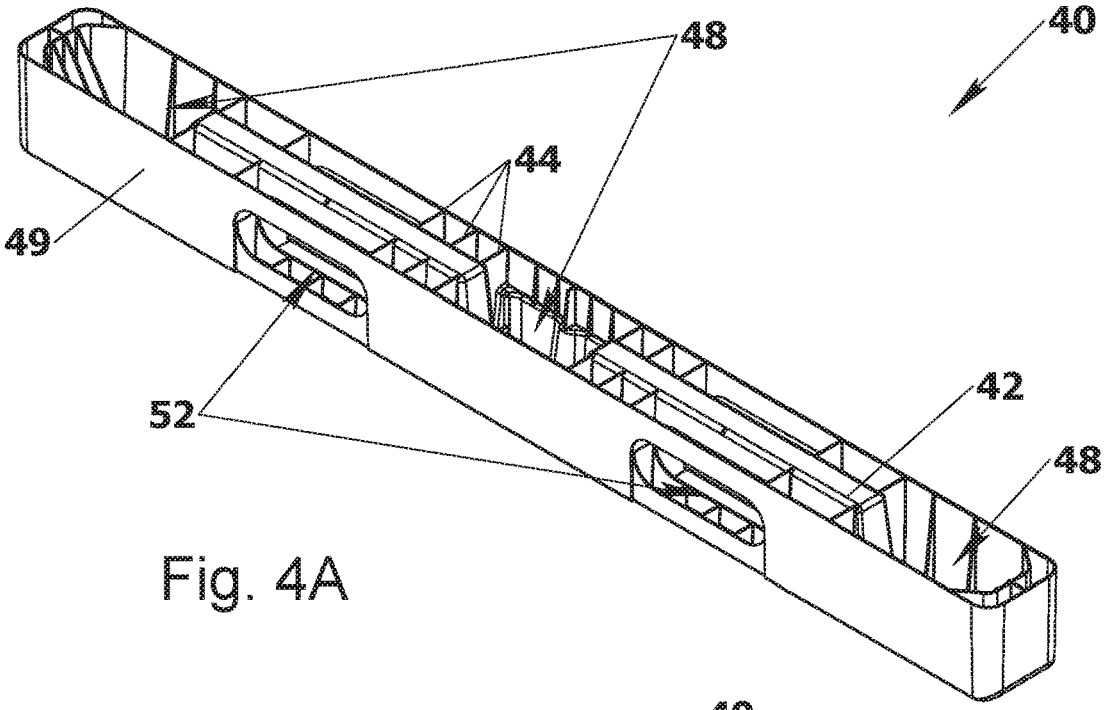
FIG. 4A is an isometric view of another embodiment of an anti-sagging device of the invention, for racking and/or shelving of pallets.
Figure 4B:
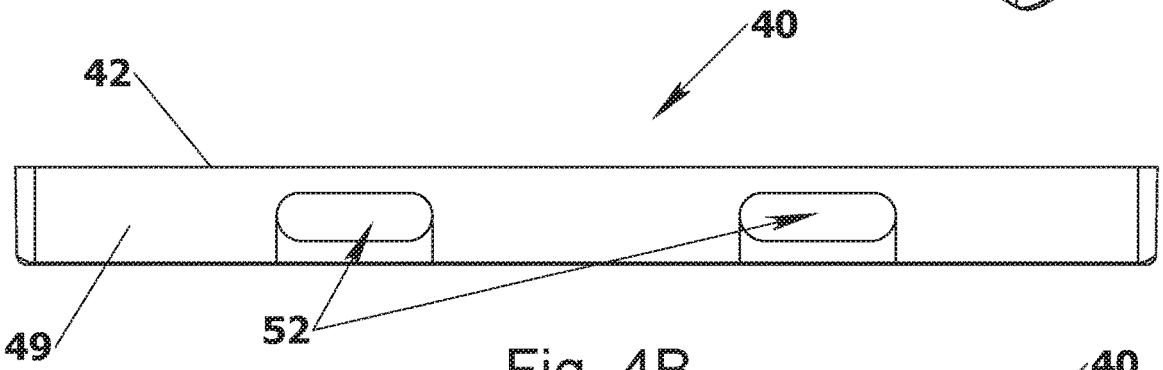
FIG. 4B is a front view of another embodiment of an anti-sagging device of the invention, for racking and/or shelving of pallets.
Figure 4C:
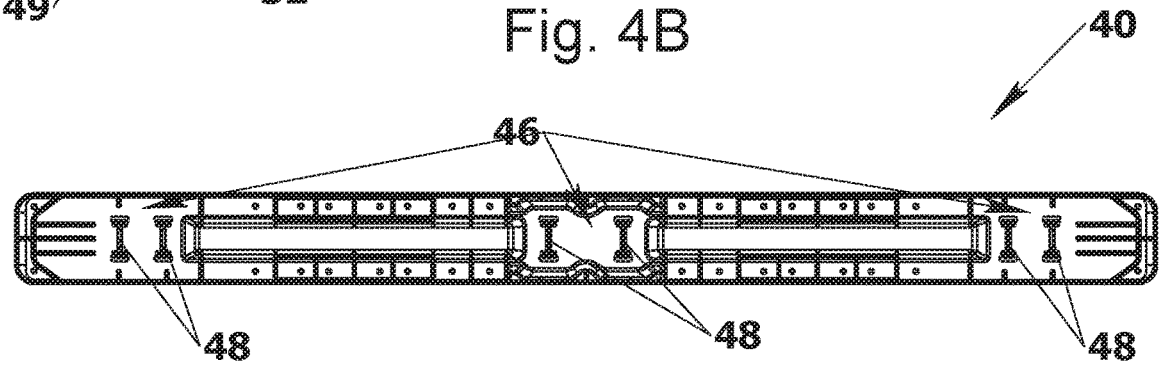
FIG. 4C is a top view of another embodiment of an anti-sagging device of the invention, for racking and/or shelving of pallets.
Figure 4D:
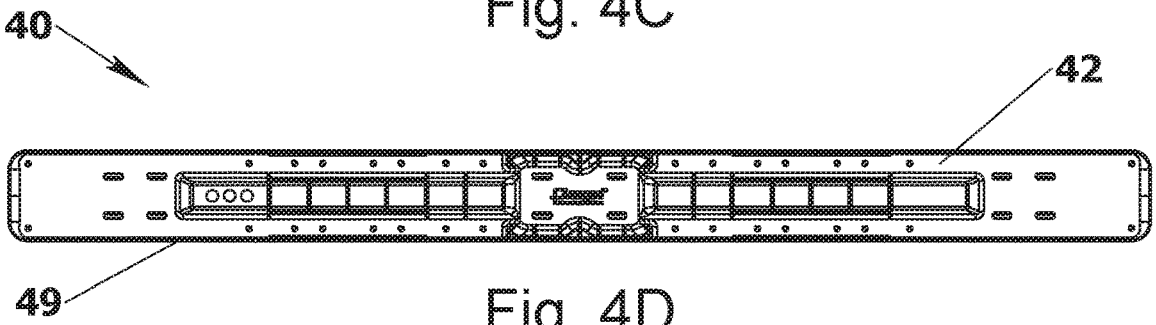
FIG. 4D is a bottom view of another embodiment of an anti-sagging device of the invention, for racking and/or shelving of pallets.

Prior to elaborating any embodiment of the present invention, in order to present the background for the inventive concept more clearly, reference is firstly made to FIGS. 1 and 2, showing prior art lightweight pallet 10 and nested assembly 20, of a plurality of prior art lightweight pallets 10A to 10E. Lightweight pallet 10 is typically made of a polymeric material, such as high-density polyethylene (HDPE), polypropylene (PP) or polyethylene terephthalate (PET), whether recycled or not.

Lightweight pallet 10 comprises upper surface plate 12, which optionally embodies a plurality of aperture patterns 14 or a plane monolithic surface, in the instance of skids. Lightweight pallet 10 comprises a plurality of legs 16, extending downwardly from upper surface plate 12. Legs 16 define void volume 18. The bottom face of legs 16 comprises apertures 22.

Lightweight, pallets such as pallet 10, are typically used for lifting and conveying goods, mounted on the pallet. However, occasionally, lightweight pallets, such as pallet 10, are used for presenting the goods to the customers, by placing the pallet on the floor or a shelf at the store and allowing customers to grab the goods directly from the pallet or skid.

As can be seen from FIG. 2, a plurality of lightweight pallets, such as lightweight pallets 10A and 108, are optionally stacked one on top of another, in a nested arrangement stack 20. The legs 16 of superior pallet 10A are inserted into and accommodated within void volume 18 of the legs 16 of pallet 10B in stack 20. The nested stack 20 is configured for conveying a plurality of lightweight pallets in a compact form.

In accordance with some embodiments of the present invention, reference FIG. 3A to 3D, showing anti-sagging device 30. Anti-sagging device 30 embodies an essentially beam resembling structure 32. Beam like structure 32 of anti-sagging device 30 optionally comprises a plurality of struts or fortification ribs 34, configured to confer structural firmness to anti-sagging device 30.

Beam like structure 32 of anti-sagging device 30 further comprises a plurality of notches 36. Notches 36 within beam like structure 32 of anti-sagging device 30 are configured to conform with and accommodate the legs of a lightweight pallet, such as legs 16 of lightweight pallet 10 shown in FIG. 1.

On the bottom face, notches 36 within beam like structure 32 of anti-sagging device 30 comprise connectors 38. The connectors 38 on the bottom face of notches 36 are configured for attaching to the apertures on the bottom face of the legs of a lightweight pallet, such as apertures 22 on the bottom face of legs 16 of lightweight pallet 10 shown in FIG. 1. The attachment mechanism of connectors 38 may vary from one embodiment to another. However the activation of connectors 38, namely the attaching of connectors 38 to the apertures on the bottom face of the legs of a lightweight pallet, is preferably performed by exerting a vertical compressing force onto the legs of a lightweight pallet, which is typically achieved by the pallet's own weight, such as by simply putting the legs of the lightweight pallet, such as legs 16 of lightweight pallet 10 shown in FIG. 1, into notches 36 within beam like structure 32 of anti-sagging device 30.

In accordance with some embodiments of the present invention, reference FIG. 4A to 4D, showing anti-sagging device 40. Anti-sagging device 40 embodies an essentially beam resembling structure 42. Beam like structure 42 of anti-sagging device 40 optionally comprises a plurality of struts or fortification ribs 44, configured to confer structural firmness to anti-sagging device 40.

Beam like structure 42 of anti-sagging device 40 further comprises a plurality of notches 46. Notches 46 are configured to conform with and accommodate the legs of a lightweight pallet, such as legs 16 of lightweight pallet 10 shown in FIG. 1. Beam like structure 42 of anti-sagging device 40 preferably further comprises surrounding envelope enclosure 49, contributing to the structural stability as well as to an aesthetic effect of anti-sagging device 40. Beam like structure 42 of anti-sagging device 40 further comprises oval apertures 52, configured for accommodating the prongs (not shown) of a forklift (not shown).

On the bottom face, notches 46 within beam like structure 42 of anti-sagging device 40 comprise connectors 48. The connectors 48 on the bottom face of notches 46 are essentially similar to connectors 38 on the bottom face of notches 36 of anti-sagging device 30 shown in FIG. 3A to 3D.

Figure 5A:
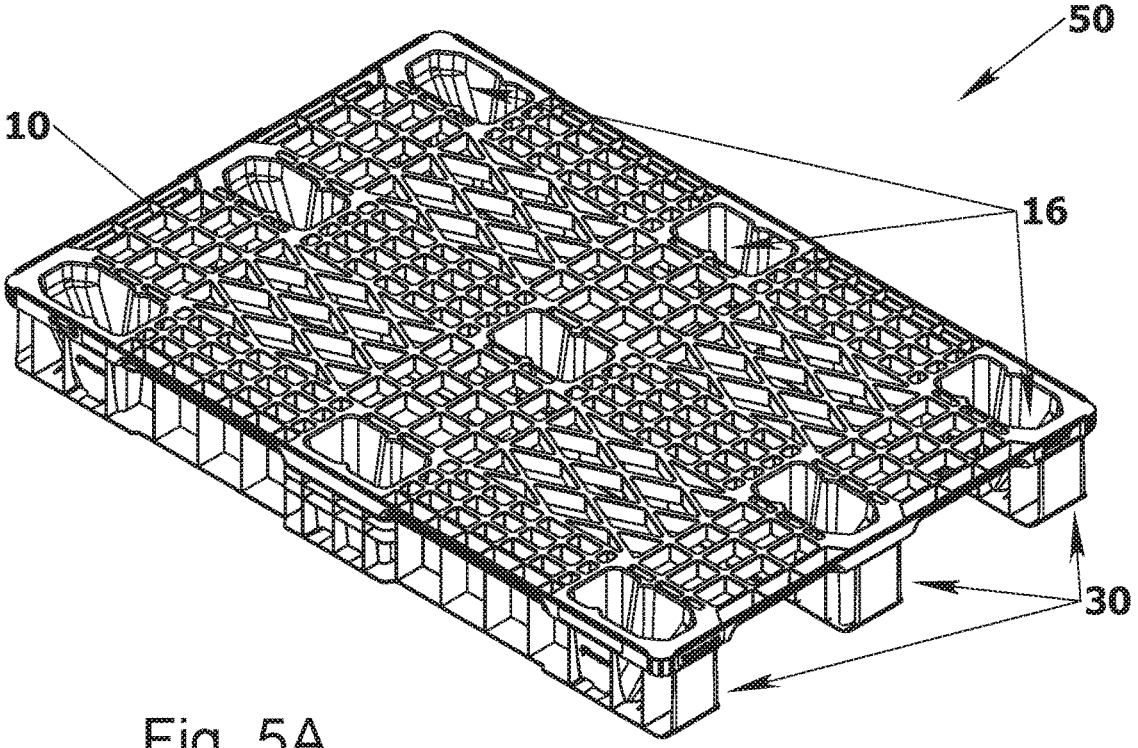
FIG. 5A is an isometric view of an assembly of prior art lightweight pallet and an embodiment of three anti-sagging devices of the invention.
Figure 5B:
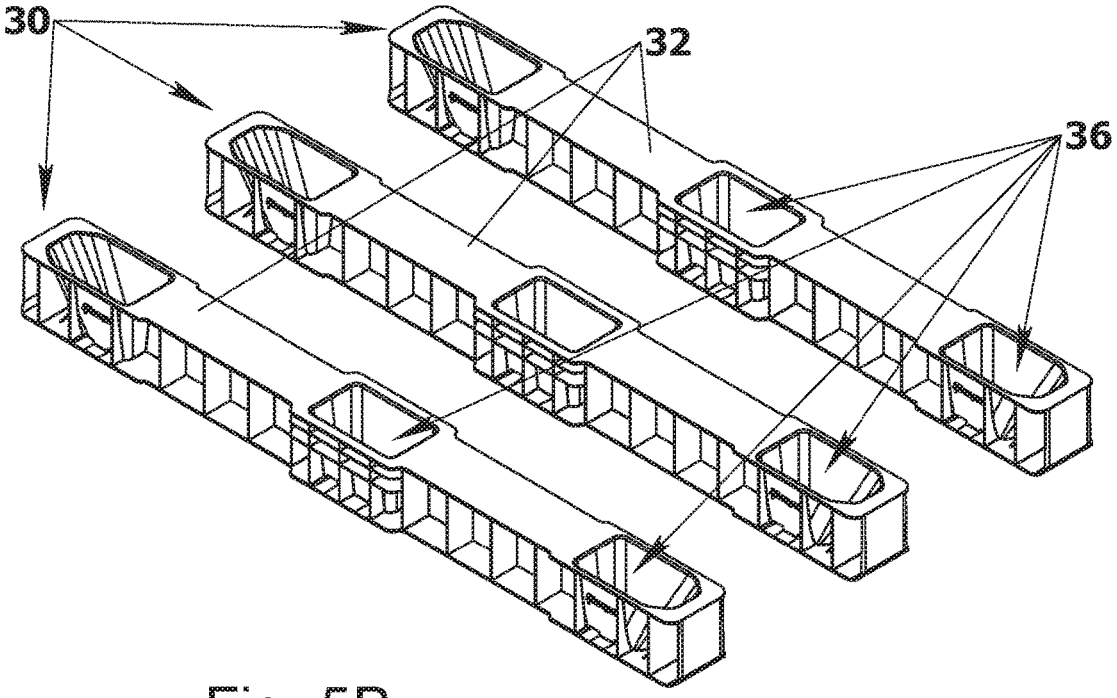
FIG. 5B is an isometric view of an embodiment of three anti-sagging devices of the invention.

Referring now to FIGS. 5A and 5B, lightweight pallet 10 is appended towards an arrangement of three anti-sagging devices 30. Legs 16 of lightweight pallet 10 are inserted into notches 36 within beam like structure 32 of anti-sagging devices 30. Lightweight pallet 10 is then released and by the virtue of its own weight connectors 38 are snapped into apertures 22 on the bottom face of legs 16, thereby securing three anti-sagging devices 30 to lightweight pallet 10 and resulting in assembly 50.

Assembly 50 of pallet 10 and three anti-sagging devices 30 is characterized by superior structural firmness. Accordingly, upon placing assembly 50 onto two side-beams (not shown) of a racking and/or shelving structure, so that the side-beams (not shown) support only the terminal portions of the anti-sagging devices 30, assembly 50 effectively does not sag while been suspended from the terminal portions of the anti-sagging devices 30 placed on the side-beams (not shown) and remains essentially planar/linear.

Figure 6A:
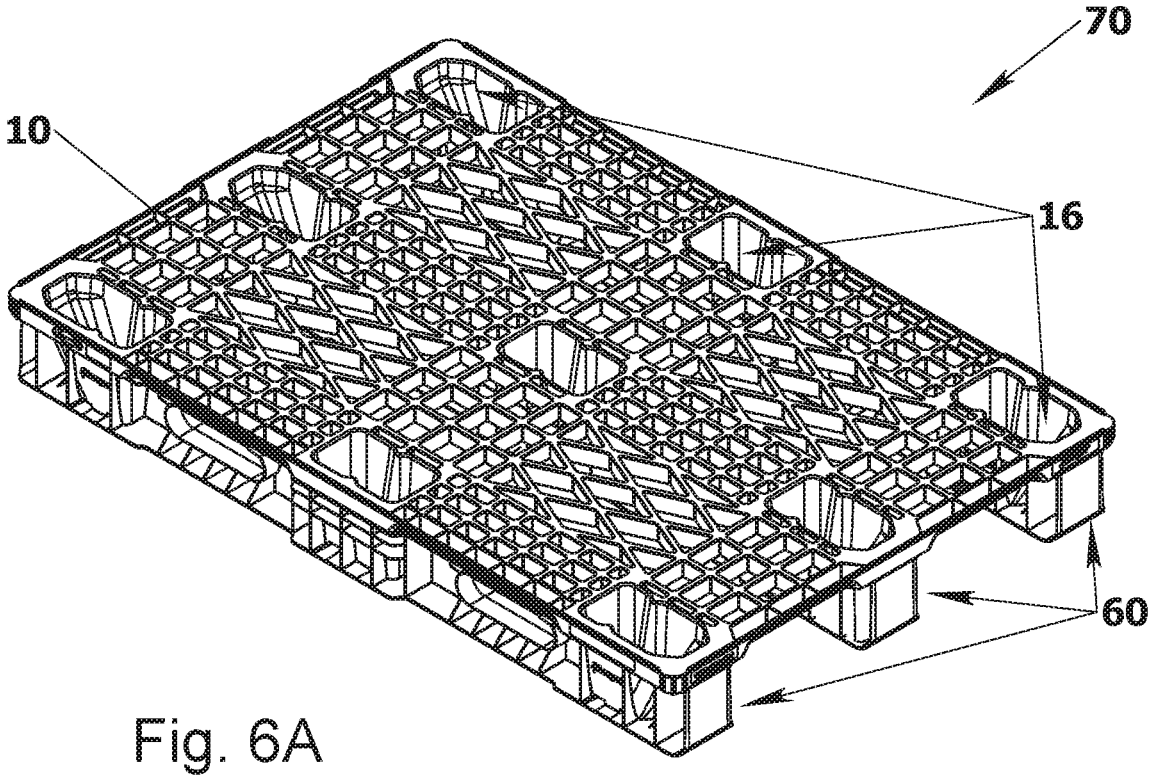
FIG. 6A is an isometric view of an assembly of prior art lightweight pallet and an embodiment of three anti-sagging devices of the invention.
Figure 6B:
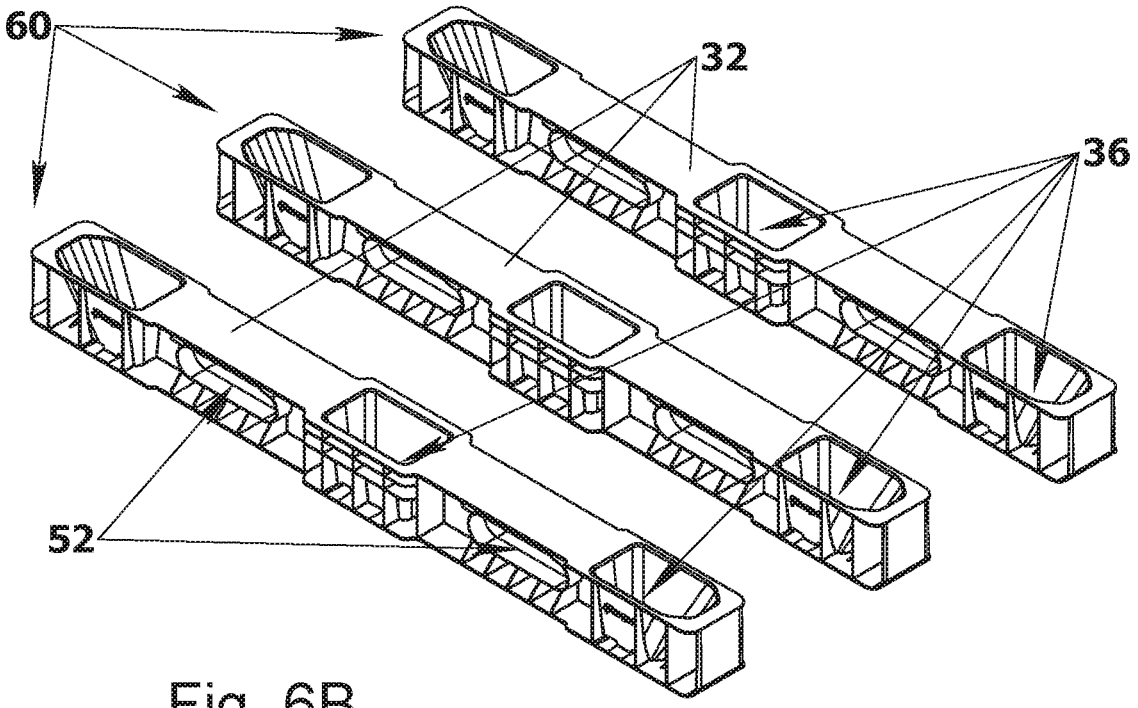
FIG. 6B is an isometric view of an embodiment of three anti-sagging devices of the invention.

Referring now to FIGS. 6A and 6B, lightweight pallet 10 is appended towards an arrangement of three anti-sagging devices 60. Legs 16 of lightweight pallet 10 are inserted into notches 36 within anti-sagging devices 60. Lightweight pallet 10 is then released and by the virtue of its own weight connectors of anti-sagging devices 60 are snapped into apertures 22 on the bottom face of legs 16 of lightweight pallet 10, thereby securing three anti-sagging devices 60 to lightweight pallet 10 and resulting in assembly 70. Assembly 70 of pallet 10 and three anti-sagging devices 30 is characterized by superior structural firmness, so that the when side-beams (not shown) support only the terminal portions of the anti-sagging devices 60, assembly 70 effectively does not sag. Assembly 70 further can be lifted by a forklift (not shown), where oval apertures 52 sustaining a four-way lifting by a forklift (not shown).

Figure 7A:
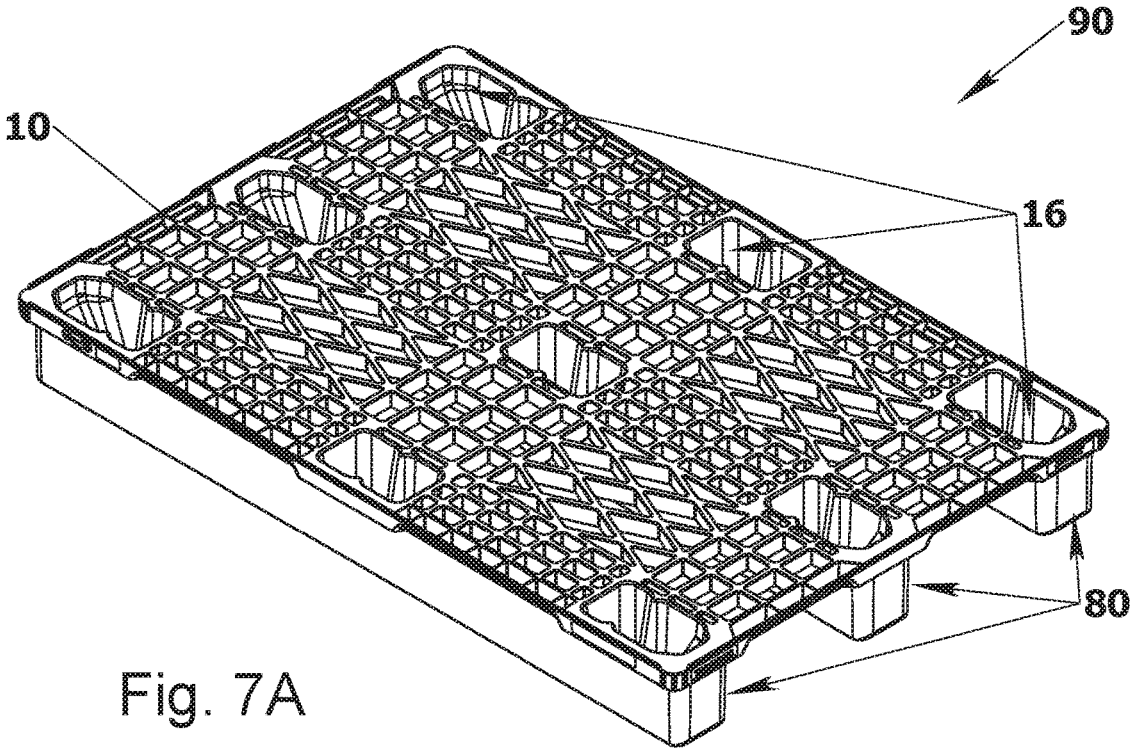
FIG. 7A is an isometric view of an assembly of prior art lightweight pallet and an embodiment of three anti-sagging devices of the invention.
Figure 7B:
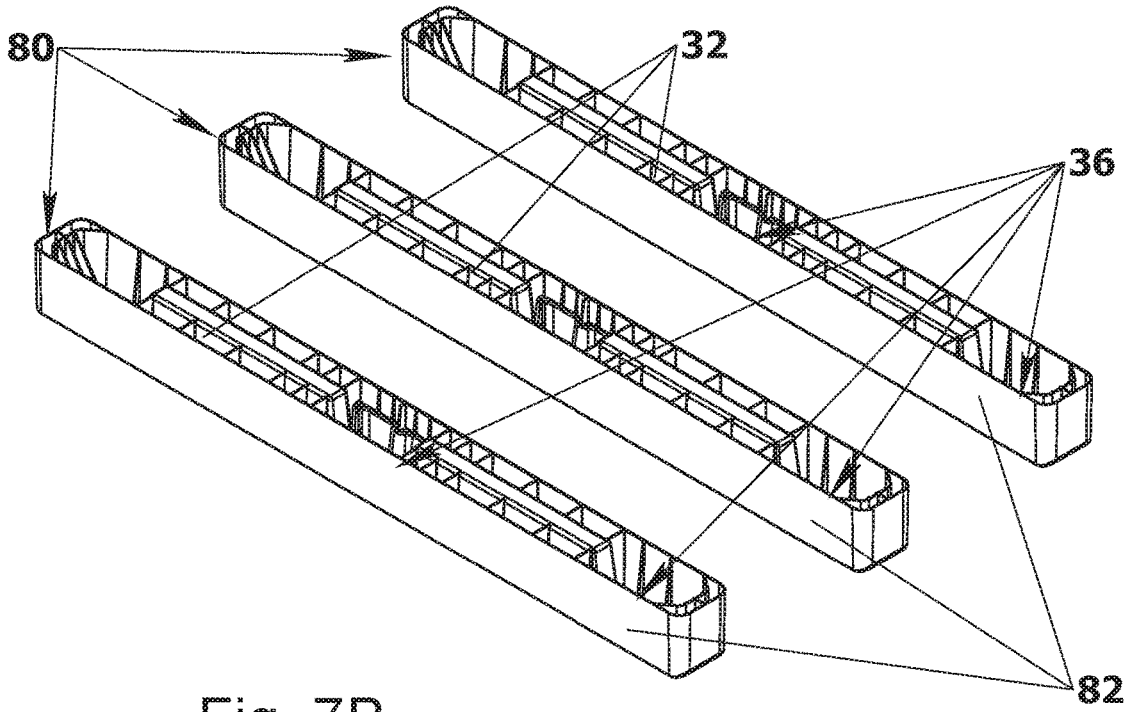
FIG. 7B is an isometric view of an embodiment of three anti-sagging devices of the invention.

Referring now to FIGS. 7A and 7B, lightweight pallet 10 is appended towards an arrangement of three anti-sagging devices 80. Anti-sagging devices 80 comprise complete surrounding envelope enclosure 82, contributing to the structural stability as well as to an aesthetic effect of anti-sagging devices 80. Legs 16 of lightweight pallet 10 are inserted into notches 36 within anti-sagging devices 80. Lightweight pallet 10 is then released and by the virtue of its own weight connectors of anti-sagging devices 80 are snapped into apertures 22 on the bottom face of legs 16 of lightweight pallet 10, thereby securing three anti-sagging devices 80 to lightweight pallet 10 and resulting in assembly 90. Assembly 90 of pallet 10 and three anti-sagging devices 30 is characterized by superior structural firmness, so that the when side-beams (not shown) support only the terminal portions of the anti-sagging devices 80, assembly 90 effectively does not sag. Assembly 90 has a superior aesthetic effect, so that lightweight pallet 10 with anti-sagging devices 80 can be placed directly on the floor or a shelf at the store, thus allowing customers to grab the goods directly from pallet lightweight pallet 10.

Figure 8A:
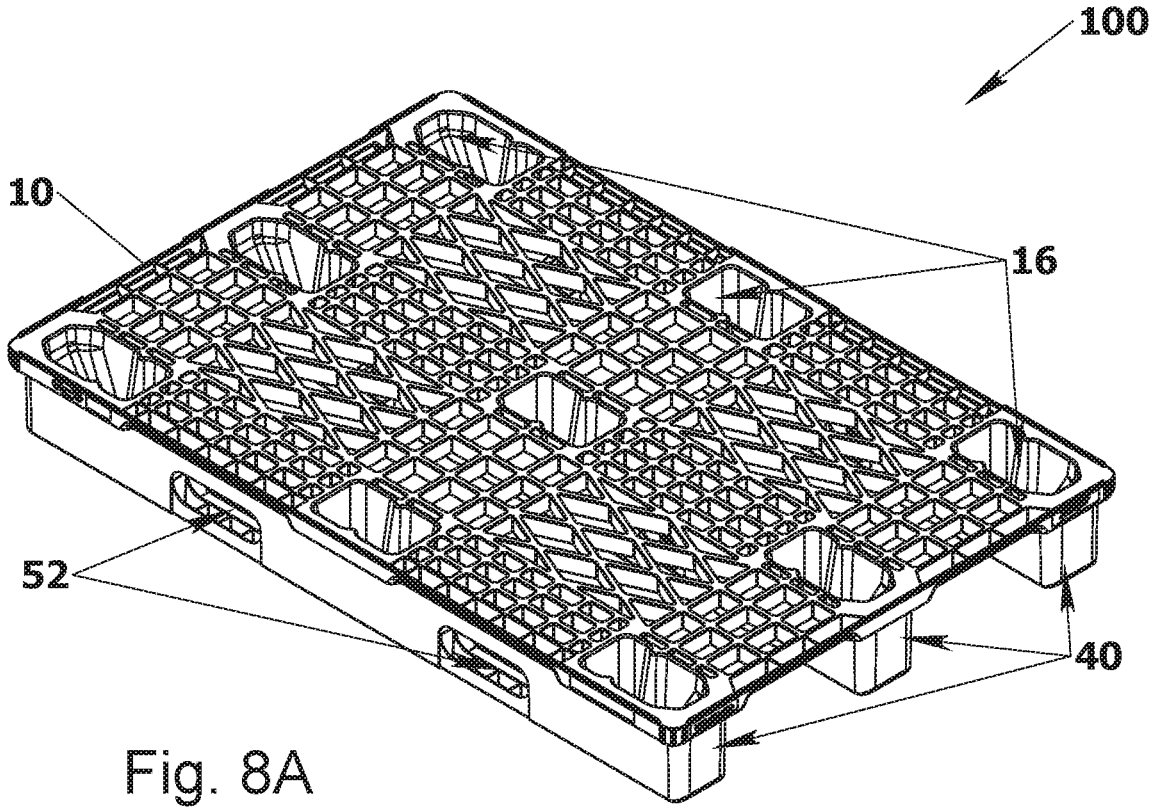
FIG. 8A is an isometric view of an assembly of prior art lightweight pallet and an embodiment of three anti-sagging devices of the invention.
Figure 8B:
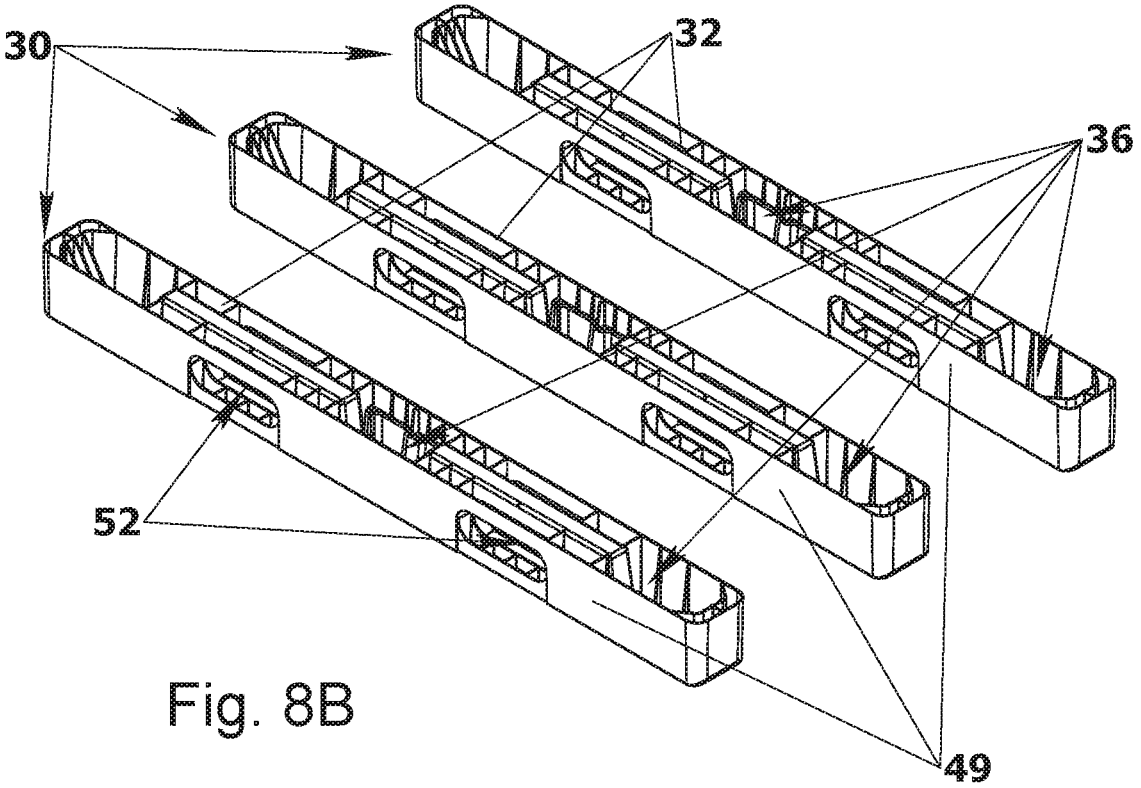
FIG. 8B is an isometric view of an embodiment of three anti-sagging devices of the invention.

Referring now to FIGS. 8A and 8B, lightweight pallet 10 is appended towards an arrangement of three anti-sagging devices 40. Anti-sagging devices 40 comprise surrounding envelope enclosure 42, contributing to the structural stability as well as to an aesthetic effect of anti-sagging devices 40. Legs 16 of lightweight pallet 10 are inserted into notches 46 within anti-sagging devices 40. Lightweight pallet 10 is then released and by the virtue of its own weight connectors of anti-sagging devices 40 are snapped into apertures 22 on the bottom face of legs 16 of lightweight pallet 10, thereby securing three anti-sagging devices 40 to lightweight pallet 10 and resulting in assembly 100. As beam like structure 42 of anti-sagging devices 40 further comprise surrounding envelope enclosure 49, contributing to the structural stability of anti-sagging device 40, assembly 100 of pallet 10 and three anti-sagging devices 40 is characterized by superior structural firmness, so that the when side-beams (not shown) support only the terminal portions of the anti-sagging devices 40, assembly 100 effectively does not sag. As beam like structure 42 of anti-sagging device 40 further comprises surrounding envelope enclosure 49, contributing to an aesthetic effect of anti-sagging device 40, so that lightweight pallet 10 with anti-sagging devices 40 can be placed directly on the floor or a shelf at the store, thus allowing customers to grab the goods directly from pallet lightweight pallet 10. Beam like structure 42 of anti-sagging device 40 further comprises oval apertures 52, configured for accommodating the prongs (not shown) of a forklift (not shown), so that assembly 100 further can be lifted by a forklift (not shown), where oval apertures 52 sustaining a four-way lifting by a forklift (not shown).

What is claimed is:

1. An assembly of a lightweight pallet and a plurality of anti-sagging devices, comprises:

(a) a lightweight pallet comprising:

(I) an essentially plate shaped structure comprising a top and bottom surfaces;

(II) a plurality of legs extending from said bottom surface of said plate structure;

(III) a plurality of structural elements disposed on a bottom face of said legs;

(b) a plurality of an anti-sagging devices, wherein each one of said anti-sagging devices comprises:

(I) an essentially beam shaped structure;

(II) a plurality of members selected from the group consisting of: struts and fortification ribs, configured to confer structural firmness to said essentially beam shaped structure;

(III) a plurality of notches configured to accommodate at least two legs of said lightweight pallet, said notches comprising a bottom face having top and bottom surfaces;

(IV) a plurality of connection mechanisms disposed on said top surface of said bottom face of said notches, said connection mechanisms are configured for fastening at least one of said plurality of said structural elements on said bottom surface of said at least two legs of said lightweight pallet;

wherein upon activation of said connection mechanisms, said plurality of said structural elements on said bottom surface of said at least two legs of said lightweight pallet are fastened to said connection mechanisms on said top surface of a bottom face of said surface of said notches of said anti-sagging devices;

wherein said activation of said connection mechanisms is performed by exerting a vertical compressing force onto said at least two legs of said lightweight pallet;

wherein at least three different faces in each one of said plurality of notches are configured to conform with and engage to at least three different faces in each one of said plurality of said legs of said lightweight pallet;

wherein at least three different faces in each one of said plurality of notches are configured to cover essentially an entire surface of at least three different faces on each one of said plurality of said legs of said lightweight pallet, thereby covering an entire surface of at least three different faces on each one of said plurality of said legs essentially to an entire height.

2. The assembly, as in claim 1, wherein said vertical compressing force does not exceed a gravitational weight of said lightweight pallet.

3. The assembly, as in claim 1, wherein said essentially beam shaped structure of said anti-sagging devices further comprises a plurality of oval apertures, configured for accommodating prongs of a forklift, thereby sustaining a four-way lifting of said assembly.

4. The assembly, as in claim 1, wherein said essentially beam shaped structure of said anti-sagging devices further comprises a surrounding envelope enclosure, contributing to an aesthetic effect of said anti-sagging device.

5. The assembly, as in claim 1, wherein said wherein said connection mechanisms are snapping fasteners.

6. The assembly, as in claim 1, characterized by superior structural firmness, wherein upon suspending terminal portions of said anti-sagging devices, said assembly effectively does not sag while been suspended from said terminal portions of said anti-sagging devices and remains essentially planar or linear.

7. An anti-sagging device, configured to conform with a lightweight pallet, comprises:

(a) an essentially beam shaped structure;

(b) a plurality of members selected from the group consisting of: struts and fortification ribs, configured to confer structural firmness to said essentially beam shaped structure;

(c) a plurality of notches configured to accommodate at least two legs of said lightweight pallet, said notches comprising a bottom face having top and bottom surfaces;

(d) a plurality of connection mechanisms disposed on a top surface of said bottom face of said notches, said connection mechanisms are configured for fastening at least one structural element on a bottom surface of said at least two legs of said lightweight pallet;

wherein upon activation of said connection mechanisms, said bottom face of said at least two legs of said lightweight pallet are fastened to said connection mechanisms;

wherein said activation of said connection mechanisms is performed by exerting a vertical compressing force onto said at least two legs of said lightweight pallet;

wherein at least three different faces in each one of said plurality of notches are configured to conform with and engage to at least three different faces in each one of said plurality of said legs of said lightweight pallet;

wherein at least three different faces in each one of said plurality of notches are configured to cover essentially an entire surface of at least three different faces on each one of said plurality of said legs of said lightweight pallet, thereby covering an entire surface of at least three different faces on each one of said plurality of said legs essentially to an entire height.

8. An anti-sagging device, as in claim 7, wherein said vertical compressing force does not exceed a gravitational weight of said lightweight pallet.

9. An anti-sagging device, as in claim 7, wherein said essentially beam shaped structure further comprises a plurality of oval apertures, configured for accommodating prongs of a forklift, thereby sustaining a four-way lifting of said pallet.

10. An anti-sagging device, as in claim 7, wherein said essentially beam shaped structure further comprises a surrounding envelope enclosure, contributing to an aesthetic effect of said anti-sagging device.

11. An anti-sagging device, as in claim 7, wherein said connection mechanisms are snapping fasteners.

12. An anti-sagging device, as in claim 7, wherein an assembly of at least two of said anti-sagging devices and said lightweight pallet is characterized by superior structural firmness, wherein upon suspending only terminal portions of said anti-sagging devices, said assembly effectively does not sag while been suspended from said terminal portions of said anti-sagging devices and remains essentially planar or linear.

13. A method of racking lightweight pellets pallet using anti-sagging devices comprises:

(a) providing a lightweight pallet comprising:

(I) an essentially plate shaped structure comprising a top and bottom surfaces;

(II) a plurality of legs extending from said bottom surface of said plate structure;

(III) a plurality of structural elements disposed on a bottom face of said legs;

(b) providing a plurality of an anti-sagging devices, wherein each one of said anti-sagging devices comprises:

(I) an essentially beam shaped structure;

(II) a plurality of members selected from the group consisting of: struts and fortification ribs, configured to confer structural firmness to said essentially beam shaped structure;

(III) a plurality of notches configured to accommodate at least two legs of said lightweight pallet, said notches comprising a bottom face having top and bottom surfaces;

(IV) a plurality of connection mechanisms disposed on said top surface of said bottom face of said notches, said connection mechanisms are configured for fastening at least one of said plurality of said structural elements on said bottom surface of said at least two legs of said lightweight pallet;

(c) assembling said lightweight pallet and said plurality of an anti-sagging devices, by exerting a vertical compressing force onto said at least two legs of said lightweight pallet;

(d) activating said connection mechanisms, thereby fastening said plurality of said structural elements on said bottom surface of said at least two legs of said lightweight pallet to said connection mechanisms on said top surface of a bottom face of said surface of said notches of said anti-sagging devices;

(e) racking an assembly of said lightweight pallet and said plurality of an anti-sagging devices onto a pair of side-beams, whereby said anti-sagging devices extend in-between said side-beams and said lightweight pallet essentially does not sag;

wherein at least three different faces in each one of said plurality of notches are configured to conform with and engage to at least three different faces in each one of said plurality of said legs of said lightweight pallet;

wherein at least three different faces in each one of said plurality of notches are configured to cover essentially an entire surface of at least three different faces on each one of said plurality of said legs of said lightweight pallet, thereby covering an entire surface of at least three different faces on each one of said plurality of said legs essentially to an entire height of said legs.

14. The method, as in claim 13, wherein said vertical compressing force does not exceed a gravitational weight of said lightweight pallet.

15. The method, as in claim 13, wherein said essentially beam shaped structure of said anti-sagging devices further comprises a plurality of oval apertures, configured for accommodating prongs of a forklift, thereby sustaining a four-way lifting of said assembly.

16. The method, as in claim 13, wherein said essentially beam shaped structure of said anti-sagging devices further comprises a surrounding envelope enclosure, contributing to an aesthetic effect of said anti-sagging device.

17. The method, as in claim 13, wherein said connection mechanisms are snapping fasteners.

18. The method, as in claim 13, wherein said assembly characterized by superior structural firmness, wherein upon suspending terminal portions of said anti-sagging devices, said assembly effectively does not sag while been suspended from said terminal portions of said anti-sagging devices and remains essentially planar or linear.

* * * * *